US010488114B1

(12) United States Patent
Goebel

(10) Patent No.: US 10,488,114 B1
(45) Date of Patent: Nov. 26, 2019

(54) FLUID-COOLED COPPER LID FOR ARC FURNACE

(71) Applicant: Materion Corporation, Mayfield Heights, OH (US)

(72) Inventor: Nathan C. Goebel, Amherst, OH (US)

(73) Assignee: Materion Corporation, Mayfield Heights, OH (US)

( * ) Notice: Subject to any disclaimer, the term of this patent is extended or adjusted under 35 U.S.C. 154(b) by 591 days.

(21) Appl. No.: 15/177,890

(22) Filed: Jun. 9, 2016

Related U.S. Application Data

(60) Provisional application No. 62/173,051, filed on Jun. 9, 2015.

(51) Int. Cl.

| | |
|---|---|
| ***F27D 9/00*** | (2006.01) |
| ***F27B 3/16*** | (2006.01) |
| ***H05B 7/18*** | (2006.01) |
| ***F27D 1/18*** | (2006.01) |

(52) U.S. Cl.
CPC ..... *F27D 9/00* (2013.01); *F27B 3/16* (2013.01); *F27D 1/1816* (2013.01); *H05B 7/18* (2013.01); *F27D 2009/0018* (2013.01)

(58) Field of Classification Search
CPC . F27D 9/00; F27D 1/1816; F27D 1/18; H05B 7/18; F27B 3/16
See application file for complete search history.

(56) References Cited

U.S. PATENT DOCUMENTS

| | | | | | |
|---|---|---|---|---|---|
| 2,766,736 | A | * | 10/1956 | Del Buono | F23M 7/00 110/173 A |
| 3,396,954 | A | * | 8/1968 | Krogsrud | F27D 17/003 110/170 |
| 3,665,085 | A | * | 5/1972 | Dumont-Fillon | C21C 5/5252 373/81 |
| 3,967,048 | A | * | 6/1976 | Longenecker | F27B 3/12 373/74 |
| 4,021,603 | A | * | 5/1977 | Nanjyo | F27D 1/1816 373/74 |
| 4,197,422 | A | * | 4/1980 | Fuchs | F27B 3/12 373/74 |
| 4,425,656 | A | * | 1/1984 | Kuhlmann | F27D 1/1816 373/74 |
| 4,443,880 | A | * | 4/1984 | Buhler | F27B 3/16 373/74 |
| 4,491,952 | A | * | 1/1985 | Honkaniemi | F27D 1/1816 373/74 |

(Continued)

FOREIGN PATENT DOCUMENTS

| | | | |
|---|---|---|---|
| JP | 62033731 | A * | 2/1987 |
| JP | 2001-215087 | A * | 8/2001 |

OTHER PUBLICATIONS

Machine translation of Japan Patent document No. 2001-215,087, Oct. 2018.*

*Primary Examiner* — Geoffrey S Evans
(74) *Attorney, Agent, or Firm* — Fay Sharpe LLP

(57) ABSTRACT

An outer lid for an arc furnace includes an outer lid formed from copper or a copper alloy. The outer lid also includes electrode ports, an off-gas chute, and a charge chute. Cooling circuits are present within the outer lid. The bottom surface of the outer lid is exposed to the internal volume of a crucible, and promotes accretion of slag, which can act as a heat barrier.

15 Claims, 12 Drawing Sheets

(56) References Cited

U.S. PATENT DOCUMENTS

| | | | | |
|---|---|---|---|---|
| 4,587,658 | A * | 5/1986 | Ball | H05B 7/12 373/95 |
| 4,654,076 | A * | 3/1987 | Camacho | C21B 13/125 219/121.36 |
| 6,084,902 | A * | 7/2000 | Hawk | F27D 1/1816 373/71 |
| 6,280,681 | B1 * | 8/2001 | MacRae | C21B 7/10 266/193 |
| 8,780,952 | B2 * | 7/2014 | Schwer | F27B 3/085 264/30 |
| 2002/0027939 | A1 * | 3/2002 | Tischenko | F27D 1/1816 373/73 |
| 2008/0192795 | A1 * | 8/2008 | Ronnberg | F27D 1/141 373/71 |
| 2008/0296006 | A1 * | 12/2008 | Manasek | F27B 3/065 165/177 |
| 2011/0243179 | A1 * | 10/2011 | Schwer | F27B 3/085 373/73 |
| 2013/0316295 | A1 * | 11/2013 | Maggioli | C21B 7/10 432/77 |
| 2014/0029643 | A1 * | 1/2014 | Lee | F27B 3/085 373/74 |
| 2016/0229698 | A1 * | 8/2016 | Nabeta | C04B 35/653 |

* cited by examiner

FLUID-COOLED COPPER LID FOR ARC FURNACE

CROSS-REFERENCE TO RELATED APPLICATIONS

This application claims priority to U.S. Provisional Patent Application Ser. No. 62/173,051, filed Jun. 9, 2015, the entirety of which is fully incorporated by reference.

BACKGROUND

The present disclosure relates to fluid-cooled copper lids for arc furnaces. Arc furnaces including the copper lid and methods of making and using the same are also disclosed.

Arc furnaces can be used to produce alloys and purified metals, such as copper-beryllium alloys. Electric arc furnaces include a crucible and a set of electrodes. Electrical current arcs between electrodes and through the material contained within the crucible. This current melts the contents of the crucible. This production process can be performed via batch processes or as a continuous process.

In conventional electrical arc furnaces, the crucible is surrounded on its bottom and side (i.e. the hearth) by highly refractory materials. The crucible is then capped with an inner carbon lid and a water-cooled outer lid made of steel. The carbon lid is also refractory (i.e., chemically and physically stable at high temperatures). Despite its high temperature properties, the extremely high temperatures needed to produce copper-beryllium alloys through carbothermic reduction typically requires temperatures of around 3000° F. (~1650° C.). This leads to excessive wear of the carbon lid, which results in furnace failure and downtime. Both the inner carbon lid and the steel water-cooled lid are also "single use" lids, requiring regular replacement.

The operation of arc furnaces is also constrained by the deterioration of the inner carbon lid and the outer water-cooled steel lid. For example, certain additives cannot be included in the charged material in the crucible, and the furnace cannot be run at higher power, without "eating" away the carbon lid even faster.

It would be desirable to provide lids for arc furnaces that are resistant to deterioration.

BRIEF DESCRIPTION

The present disclosure relates to fluid-cooled copper lids for arc furnaces. Using copper is contemplated to remove the problems associated with using steel. In particular, the copper lid can be continually reused, and will not deteriorate. Also, it is contemplated that the copper lid can be used by itself, without the need for the inner carbon lid. This will remove failure modes due to the carbon lid, and can also help reduce contamination of the final alloy formed within the crucible.

Disclosed in various embodiments are outer lids for an arc furnace, comprising: a top surface and a bottom surface; a plurality of electrode ports; an off-gas chute; a charge chute; and at least one cooling circuit within the outer lid for flowing a cooling fluid, each cooling circuit comprising an inlet and an outlet; wherein the outer lid is made of copper or a copper alloy.

The bottom surface of the outer lid can be shaped to promote accretion. For example, the bottom surface may comprise a plurality of pockets for accumulating accretion. Sometimes, the pockets are filled with a carbon refractory material that promotes accretion of, for example, slag.

More particularly, the plurality of electrode ports consists of three electrode ports located within a delta section of the outer lid.

In specific embodiments, the at least one cooling circuit consists of five cooling circuits within the outer lid. Two cooling circuits can be located along an outer perimeter of the outer lid and three cooling circuits can be located around the plurality of electrode ports.

In some particular embodiments, the bottom surface of the outer lid has a frustoconical disk shape.

The outer lid may further comprise a water-cooled sleeve for the off-gas chute; and/or a water-cooled sleeve for the charge chute. The outer lid can also further comprise a plurality of electrode rings, one electrode ring being used in each electrode port. In specific embodiments, each electrode ring is made from two split parts, and the seams of the parts can be shaped to prevent a direct energy path through the seams. Each electrode ring can be made from a refractory material selected from the group consisting of zirconia ($ZrO_2$), silicon carbide, alumina ($Al_2O_3$), silica ($SiO_2$), magnesia (MgO), tungsten carbide, boron nitride, hafnium carbide, tantalum hafnium carbide, chromia ($Cr_2O_3$), dolomite, and periclase.

In some embodiments, the bottom surface of the outer lid is flat.

Sometimes, the outer lid is formed as a single integral structure. In other embodiments, the outer lid is formed from a delta section and a base ring section which can be joined together. The delta section contains the plurality of electrode ports and contains three cooling circuits. The base ring section contains two cooling circuits.

It is specifically contemplated that the outer lid can be made from the C81100 copper alloy, which is a minimum of 99.7 wt % copper.

The outer lid can be designed so that the cooling fluid is flowed through each cooling circuit at a flow rate of about 40 gallons/minute to about 80 gallons/minute. Desirably, the cooling fluid is flowed through each cooling circuit so that a temperature differential between the inlet and the outlet is at most about 30° F.

Also disclosed herein are arc furnaces, comprising: a crucible; and a roof comprising the outer lid as described above. The roof may further comprise an inner lid comprising carbon. The roof may further comprise a support ring to which the outer lid is attached.

Also disclosed herein are processes for making a beryllium-copper alloy using the outer lid as described above. Briefly, beryllium and copper are fed into a crucible which is capped with the outer lid. The beryllium and copper are then melted to make the beryllium-copper alloy. An organic binder may also be fed into the crucible.

These and other non-limiting characteristics of the disclosure are more particularly disclosed below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
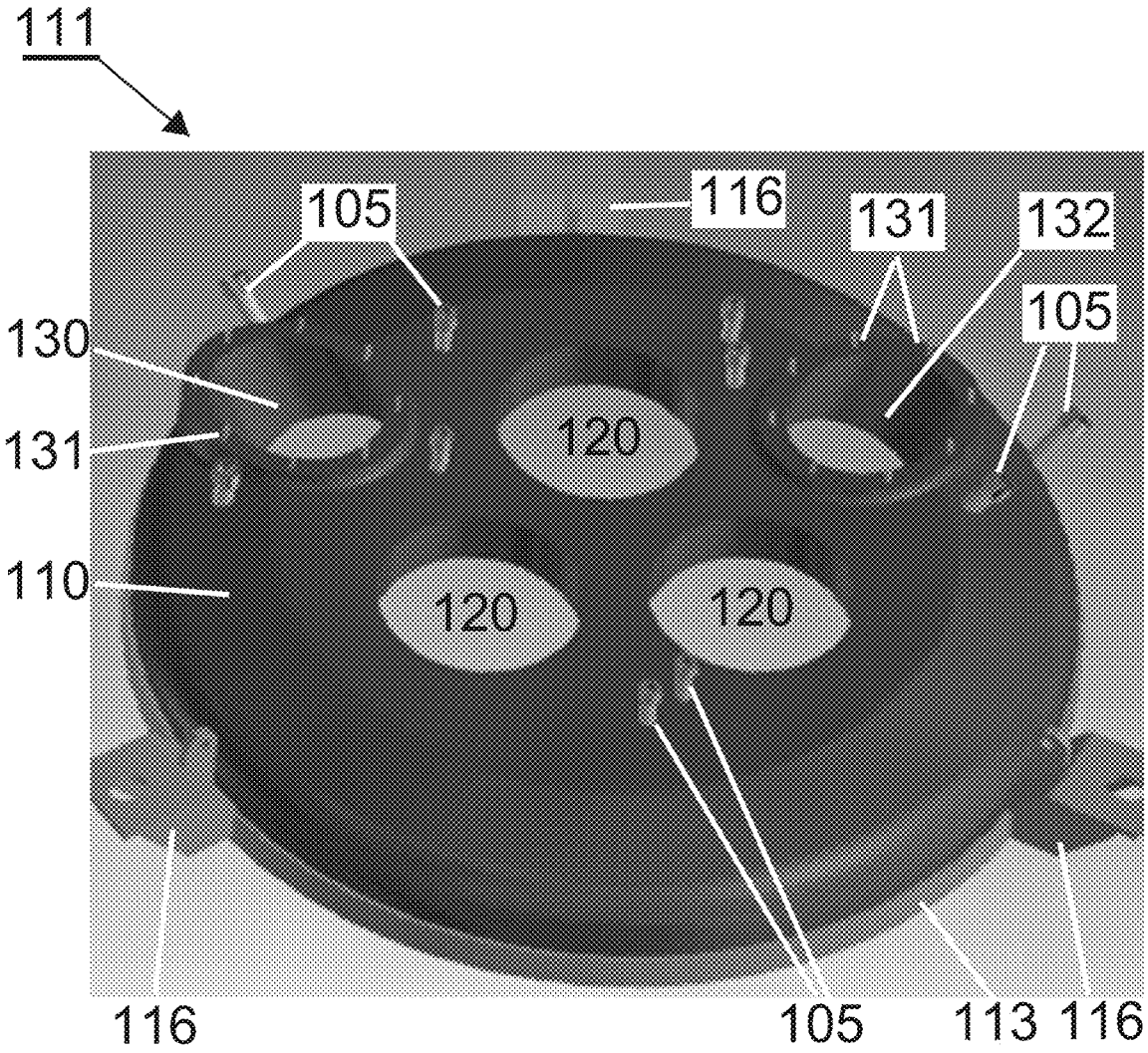
FIG. 1 is a top perspective view of an exemplary arc furnace outer lid in accordance with the present disclosure.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the term "comprising" may include the embodiments "consisting of" and "consisting essentially of." The terms "comprise(s)," "include(s)," "having," "has," "can," "contain(s)," and variants thereof, as used herein, are intended to be open-ended transitional phrases, terms, or words that require the presence of the named components/steps and permit the presence of other components/steps. However, such description should be construed as also describing compositions or processes as "consisting of" and "consisting essentially of" the enumerated components/steps, which allows the presence of only the named components/steps, along with any impurities that might result therefrom, and excludes other components/steps.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 to 10" is inclusive of the endpoints, 2 and 10, and all the intermediate values).

The term "about" can be used to include any numerical value that can vary without changing the basic function of that value. When used with a range, "about" also discloses the range defined by the absolute values of the two endpoints, e.g. "about 2 to about 4" also discloses the range "from 2 to 4." The term "about" may refer to plus or minus 10% of the indicated number.

The present disclosure relates to copper lids for arc furnaces. Arc furnaces including the lids and methods of making and using the same are also disclosed.

Figure 11:
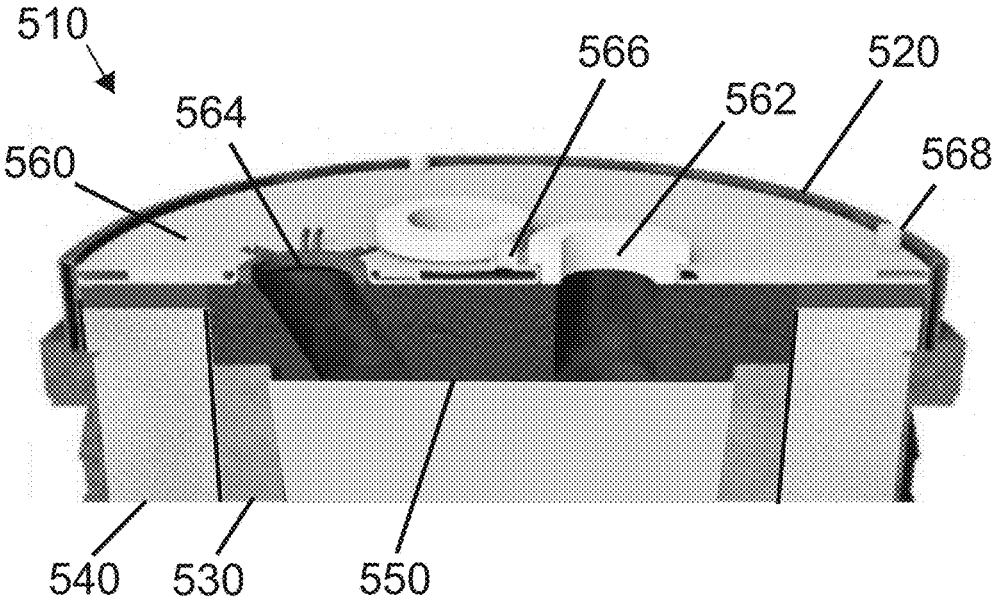
FIG. 11 is a cross-sectional view of an arc furnace using a conventional prior art steel water-cooled outer lid, and is provided for comparison.

It may be helpful to first describe the lids currently used with arc furnaces, so that a clear understanding of the differences can be attained. FIG. 11 is a side-cross-sectional perspective view showing the top portion of a conventional arc furnace 510. This portion of the arc furnace includes sidewalls 520 made of steel. Located within the sidewalls is a crucible 530, with refractory material 540 being placed between the crucible and the sidewalls. An inner carbon lid 550 is then placed over the crucible, and an outer water-cooled steel lid 560 is placed over the inner carbon lid. Together, the inner carbon lid and the outer steel lid form a roof for the crucible. The steel lid has three electrode ports 562 (only two are visible) through which electrodes enter the crucible. The steel lid also includes an off-gas chute 564 and a charge chute (not visible). It is noted that the electrode ports 562 extend straight through the lid (i.e. perpendicular to the surfaces of the lid), while the off-gas chute 564 is angled (a 30° angle) through the lid. In addition, the steel lid is water-cooled. The water enters the steel lid through one inlet 566 at the center of the lid, and the water flows through three different channels to exit at three outlets 568 on the perimeter of the lid (only two visible).

The bottom surface of the lid is flat, and here, the top surface is also flat, so that the steel lid has a relatively constant thickness from the center to the perimeter. In this regard, the inner carbon lid has a thickness of about 14 inches, and the outer steel lid has a thickness of about 1.5 inches.

The inner carbon lid 550 has a diameter that is about equal to that of the crucible 530, and the carbon lid rests on the crucible. In contrast, the steel lid 560 has a diameter sufficient to cover both the crucible 530 and the refractory material 540, and rests on a ledge of the sidewall 510.

As discussed above, one problem with the conventional roof of the furnace is that the carbon lid deteriorates and fails, particularly at the high temperatures needed to make copper-beryllium alloys. It would be desirable to provide a roof that does not need to rely on the inner carbon lid, and if possible it would be desirable to get rid of the carbon lid entirely. This goal can be advanced with the water-cooled outer lids of the present disclosure, which are made of copper or a copper alloy. This lid can be lined with minimal carbon on the underside. Desirably, it is contemplated that an autogenous lining of furnace dross can be formed under the lid, acting as a refractory material instead of needing the inner carbon lid.

The outer lid of the present disclosure is made from pure copper or a copper alloy. In some embodiments, the copper alloy is C81100, which contains a minimum of 99.7 wt % copper. 81100 has an ultimate tensile strength of about 25 ksi and a typical Brinell hardness of 44 at 500 lb load.

Figure 2:
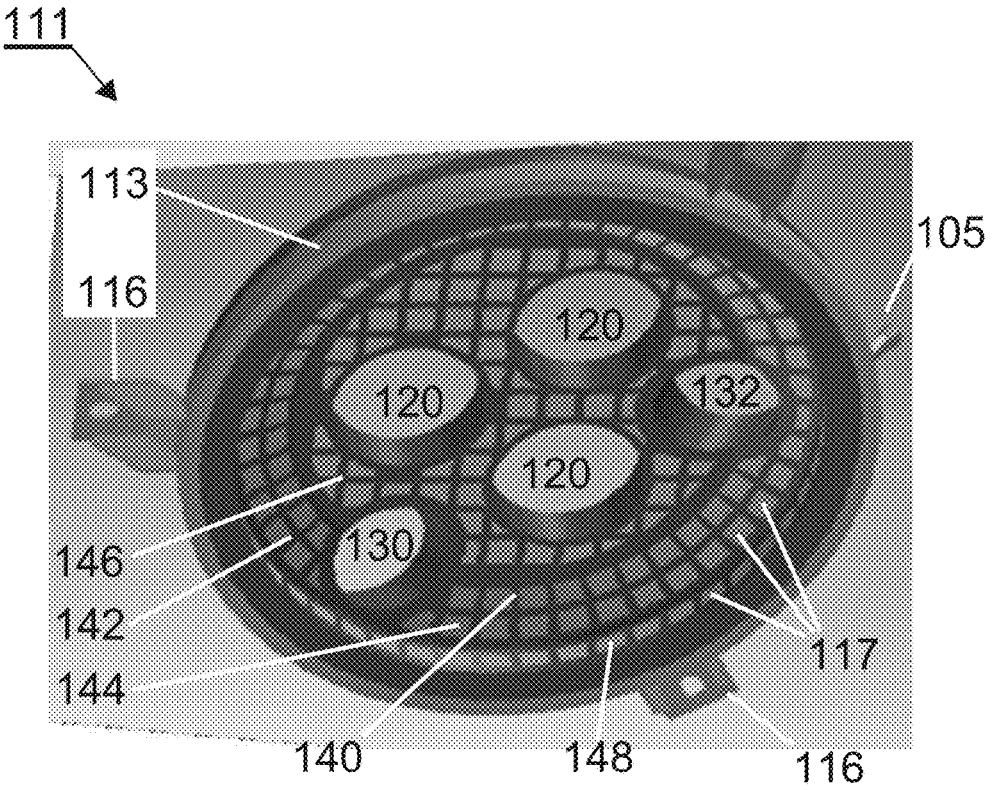
FIG. 2 is a bottom perspective view of the outer lid of FIG. 1.
Figure 3:
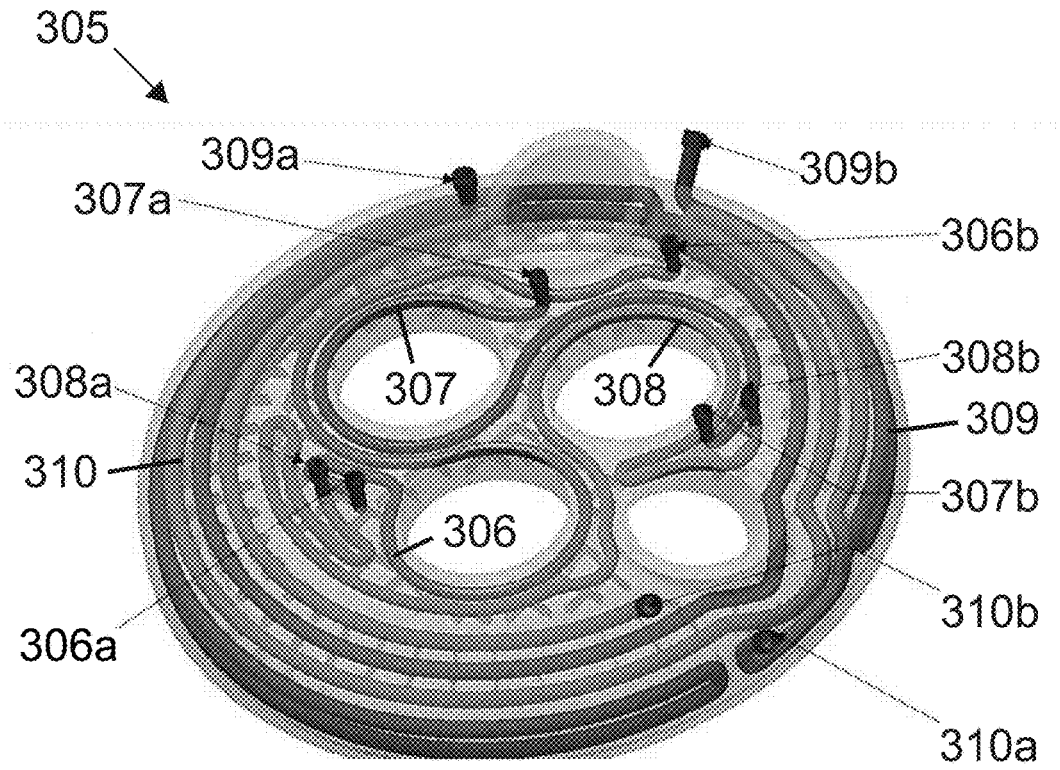
FIG. 3 is a top perspective view of an exemplary cooling system for the outer lid of FIG. 1.
Figure 4:
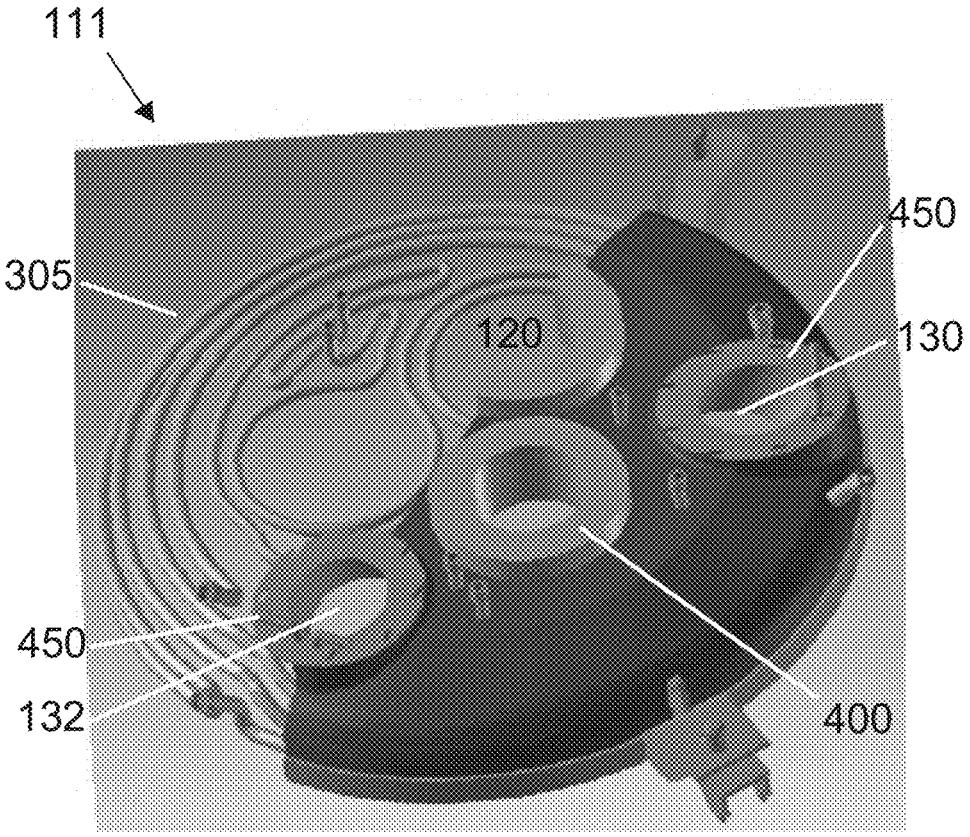
FIG. 4 is a top perspective cut-away view of the outer lid of FIG. 1.
Figure 5:
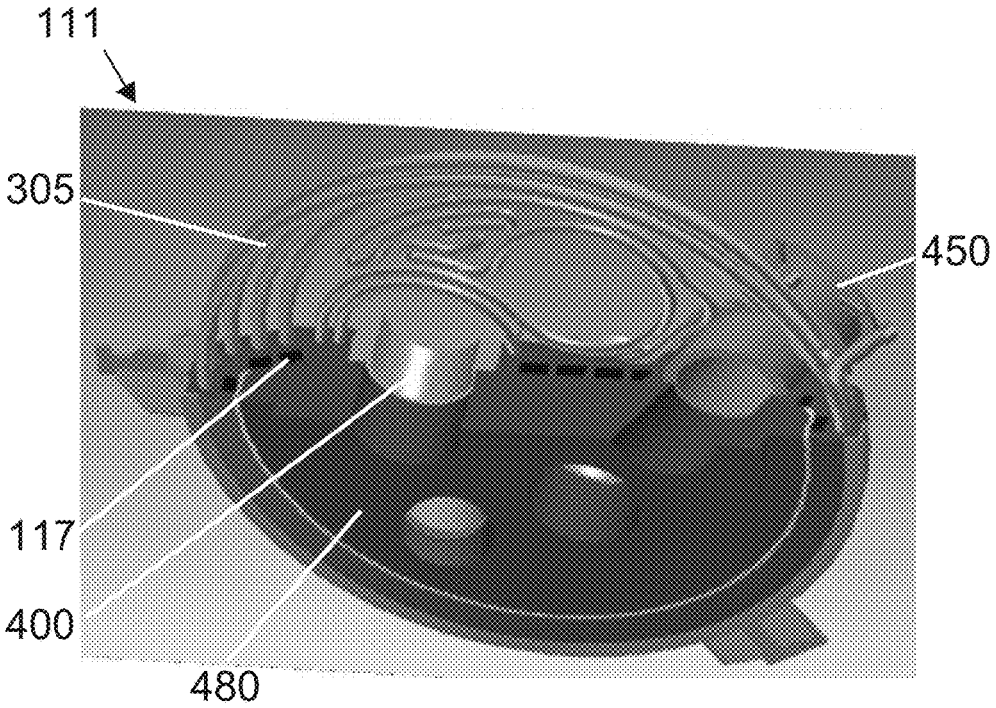
FIG. 5 is a bottom perspective cut-away view of the outer lid of FIG. 1.

FIGS. 1-5 are different views of an exemplary outer lid of the present disclosure, which is made from copper or a copper alloy. FIG. 2 is a top perspective view of one exemplary copper outer lid 111 of the present disclosure. FIG. 2 is a bottom perspective view of the copper lid 111. FIG. 3 is an internal perspective view showing the bottom surface of the lid 111 and the five cooling circuits within the lid. FIG. 4 is a top perspective view showing the cooling circuits along with the top surface of the lid. FIG. 5 is a bottom perspective view similar to that of FIG. 4.

Referring first to FIG. 1, the top surface 110 of the outer lid 111 includes a plurality of fluid inlets/outlets 105, a plurality of electrode ports 120, an off-gas chute 130, and a charge chute 132. The three electrode ports 120 shown here are offset around the center of the lid at 120° angles. Though it is difficult to tell, again, the off-gas chute 130 and the charge chute 132 are angled through the lid, while the electrode ports extend straight through the lid. Connection members 131 are also shown around the off-gas chute and the charge chute, and are used for securing other pipes (not shown) to these chutes. The lid 111 is connected to a support ring 113 which includes a plurality of mounting brackets 116.

FIG. 2 is a bottom view of the copper outer lid 211. Initially, a fluid inlet/outlet 105 is visible, as is the support ring 113 and the mounting brackets 116. The electrode ports 120, the off-gas chute 130, and the charge chute 132 are also visible. Notably, the bottom surface 140 of the lid 211 is shaped to promote accretion. This is done primarily by methods which increase the surface area of the bottom surface. As shown here, the bottom surface includes a plurality of pockets 117 which are inset into the body of the lid. It is contemplated that these pockets can be filled with a refractory material which will help to promote accretion of materials onto the bottom surface. For example, the refractory material may be a carbon material, such as Morram 8301, commercially available from Morgan Advanced Materials, which is a high quality graphite ramming materials for use where high thermal conductivity is required. The bottom surface 140 has a frustoconical disk shape. The "frustoconical" part of the bottom surface is the inner portion 142 of the surface containing the ports 120 and the chutes 130/132. The inner portion 142 can be divided into a sloped surface 144 and a planar surface 146. The electrode ports 120 are located on the planar surface 146, while the chutes 130/132 traverse both surfaces. As will be seen later, the planar surface 146 can be considered to define a delta section of the lid. The "disk" part of the bottom surface is the outer portion 148 of the surface that extends vertically in the direction of the crucible. This outer portion also contains pockets 117.

FIG. 3 shows the cooling system 305 that is incorporated into the otherwise solid copper lid. The cooling system 305 includes at least one cooling circuit, with each cooling circuit being defined by a pipe having an inlet and an outlet. Generally, any suitable number of cooling circuits may be present as long as they maintain the copper lid at a safe operating temperature, usually 400° C. or less. The number of circuits may be in the range of from 1 to about 9, including from about 3 to about 7. The circuits should be arranged to focus their cooling on areas that are susceptible to high and long-lasting heat loads. Cooling fluid is pumped through each cooling circuit to absorb and remove heat.

In the illustrated system, there are five cooling circuits. The first cooling circuit 306 includes an inlet 306*a* and an outlet 306*b*. The second cooling circuit 307 includes an inlet 307*a* and an outlet 307*b*. The third cooling circuit 308 includes an inlet 308*a* and an outlet 308*b*. The fourth cooling circuit 309 includes an inlet 306*a* and an outlet 309*b*. The fifth cooling circuit 310 includes an inlet 310*a* and an outlet 310*b*. It is noted that the location of the inlets and outlets can be reversed as desired for each cooling circuit, i.e. the designation of one end as an inlet is arbitrary.

Three of the cooling circuits 306, 307, 308 are relatively short, and are focused in the delta section around the three electrode ports. Each of these cooling circuits 306, 307, 308 completely surrounds the perimeter of one electrode port and a portion of the perimeter of another electrode port. The other two cooling circuits 309, 310 run around the outer perimeter of the lid. The cooling circuits are also arranged to provide space for the off-gas chute and the charge chute. It is noted that in embodiments, the three cooling circuits focused in the delta section have a smaller diameter than the two cooling circuits around the outer perimeter (1.25 inches versus 1.0 inches).

Cooling fluid flows through the cooling circuits to remove heat. Generally, the cooling fluid can be flowed through each circuit at a flow rate of about 40 gallons/minute (GPM) to about 80 GPM, including from about 45 GPM to about 65 GPM. The flow rate should be such that the temperature differential between the inlet and the outlet is at most about 30° F., more ideally about 20° F. One advantage of this cooling system is that each cooling circuit can be individually controlled to provide additional cooling fluid to those areas of the copper lid that may be exposed to higher temperatures. In contrast, the prior art system in FIG. 11 had one inlet which fed three different flowpaths equally and could not provide such control.

Referring now to FIG. 4 and FIG. 5, these two views show additional aspects of the copper lid 111. These two views show the cooling system 305 along with a portion of the copper body. In FIG. 4, electrode rings 400 are present in the electrode ports 120. Water-cooled sleeves 450 are also present in the two chutes 130, 132. Details on these additional structures are provided further below.

In FIG. 5, it can be seen that the copper lid 111 is essentially a solid body of copper, with the cooling system 305 and pockets 117 embedded therein. It can also be seen that the electrode rings 400 and the sleeves 450 extend entirely through the lid from the top surface to the bottom surface. In addition, an inner carbon lid 480 is located within the volume defined by the bottom surface of the outer lid.

Figure 6:
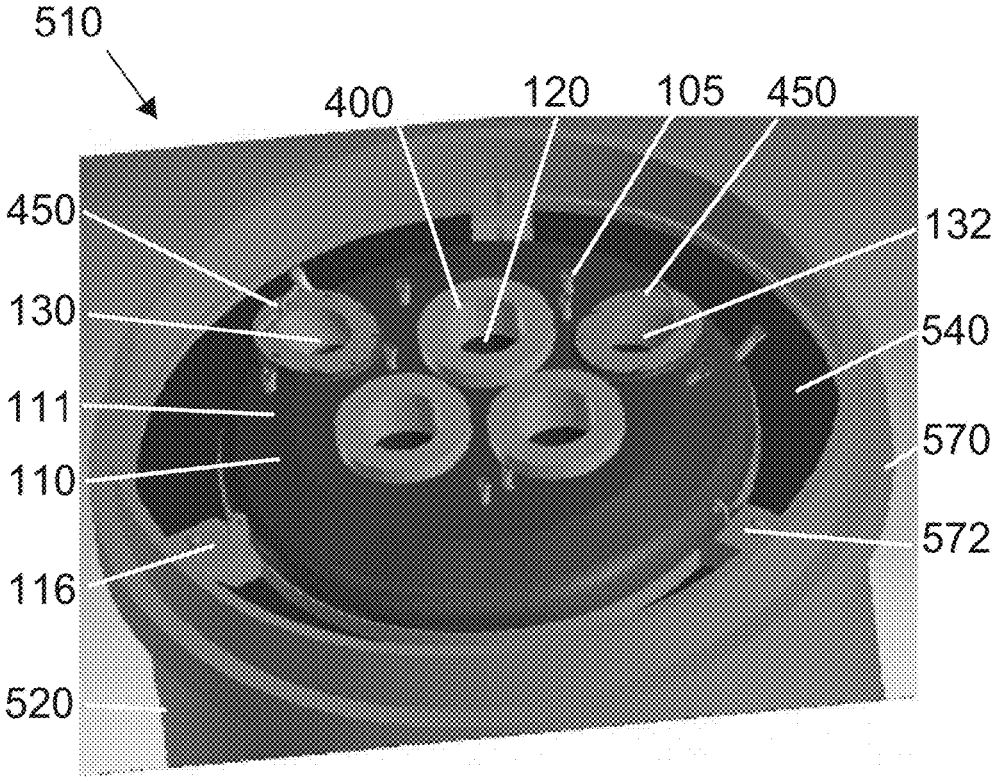
FIG. 6 is a top perspective view showing an exemplary outer lid mounted on the crucible of an arc furnace.
Figure 7:
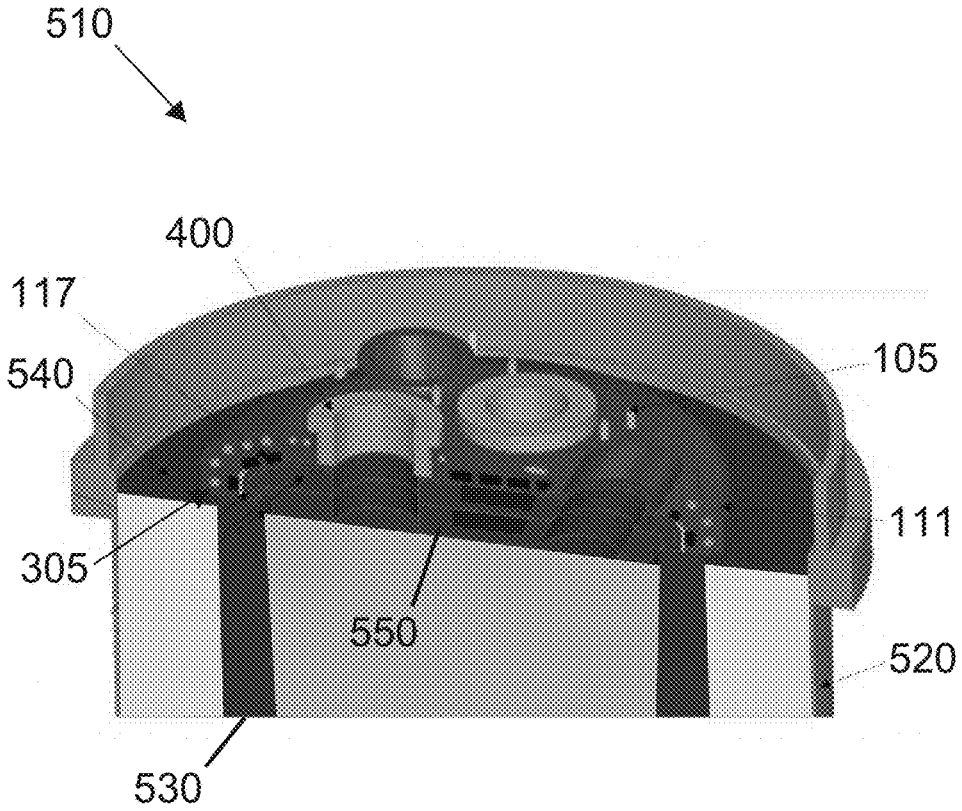
FIG. 7 is a cross-sectional view of the crucible and arc furnace of FIG. 6.

FIG. 6 and FIG. 7 illustrate an exemplary arc furnace 510 using the copper lid 111 of the present disclosure. FIG. 6 is a top external perspective view, and FIG. 7 is a side cross-sectional view.

Referring to FIG. 6, the arc furnace 510 includes the copper lid 111. There are a plurality of electrode rings 400, one in each electrode port 120. The water-cooled sleeves 450 are also visible in the chutes 130, 132. Fluid inlet/outlets 105 extend from the top surface 110 of the lid 111. The sidewalls 520 of the furnace are visible as well.

It is noted that one aspect of the copper lid 111 is its smaller diameter when compared to the steel lid 560 of FIG. 11. The copper lid does not have a diameter that completely covers the refractory material 540 anymore. Also, the copper lid 111 is much thicker (12 inches) than the steel lid 560 was. As a result, a new roof support ring 570 is placed over the sidewalls 520 of the furnace to join the copper lid to a support structure that can bear its weight. Support brackets 572 extend from the roof support ring 570 to engage the mounting brackets 116 of the lid 111.

Referring now to FIG. 7, the sidewalls 520 of the furnace, the refractory material 540, and the crucible 530 are visible. A carbon inner lid 550 is also illustrated here, but it is noted that the thickness of this lid 550 is much less than the one illustrated in FIG. 11 (only five to six inches, instead of 12). The solid copper construction of the copper outer lid 111 is visible, as are some cooling circuits 305 and the pockets 117 on the bottom surface of the lid 111. The electrode ring 400 is shown, though the water-cooled sleeves are not.

Figure 8A:
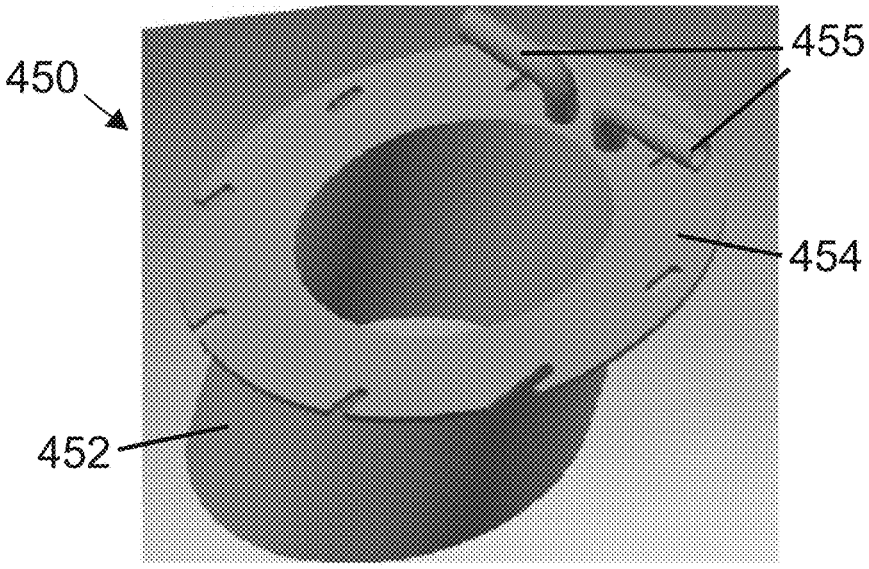
FIG. 8A and FIG. 8B are perspective views of two different sleeves to be used with the copper outer lid in accordance with some embodiments of the present disclosure.
Figure 8B:
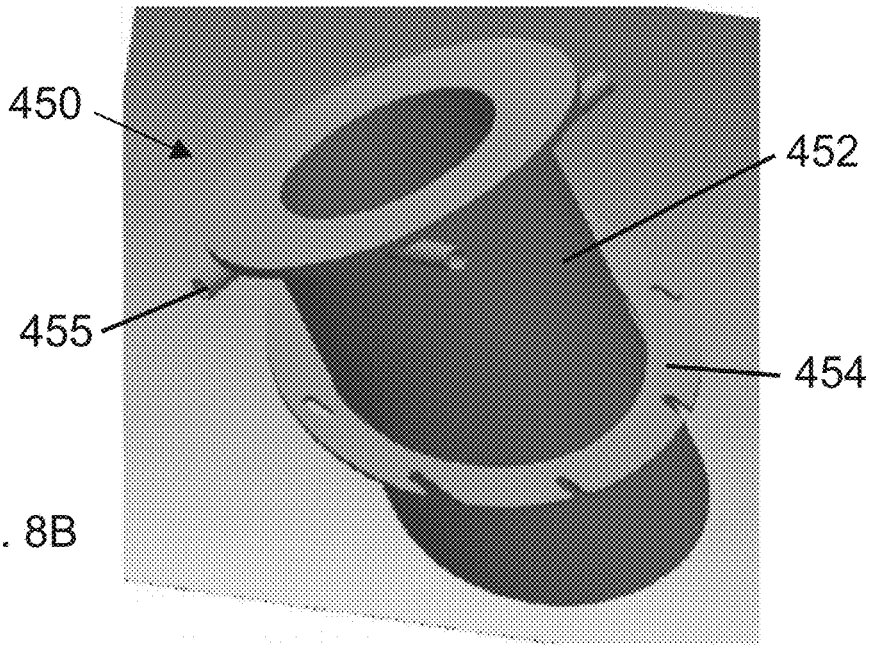

FIG. 8A and FIG. 8B illustrate two examples of fluid-cooled sleeves 450 that are used with the off-gas chute and the charge chute. These are designed to be a replaceable guard material between the copper lid and the abrasive charge and off-gas materials that pass through the chutes. Each sleeve 450 includes a sidewall 452 and a flange 454, which is used to secure the sleeve to the copper lid 111. Fluid inlet/outlets 455 are also present. A cooling circuit runs through the sidewall of the sleeve. Each sleeve is intended to extend entirely through the chute so as to protect the copper lid, and as a result the sidewall of the sleeve may have a length of from about 8 inches to about 15 inches, including about 11.5 inches. A flow rate of about 20 GPM to about 30 GPM is recommended for these sleeves. They are designed to deliver water first to the bottom of the sidewall (near the bottom surface of the outer lid), where the heat is greatest, and then flow the water back up around the sidewall to the top. FIG. 8A and FIG. 8B differ in that the sidewall of FIG. 8B extends above the flange 454.

Figure 9:
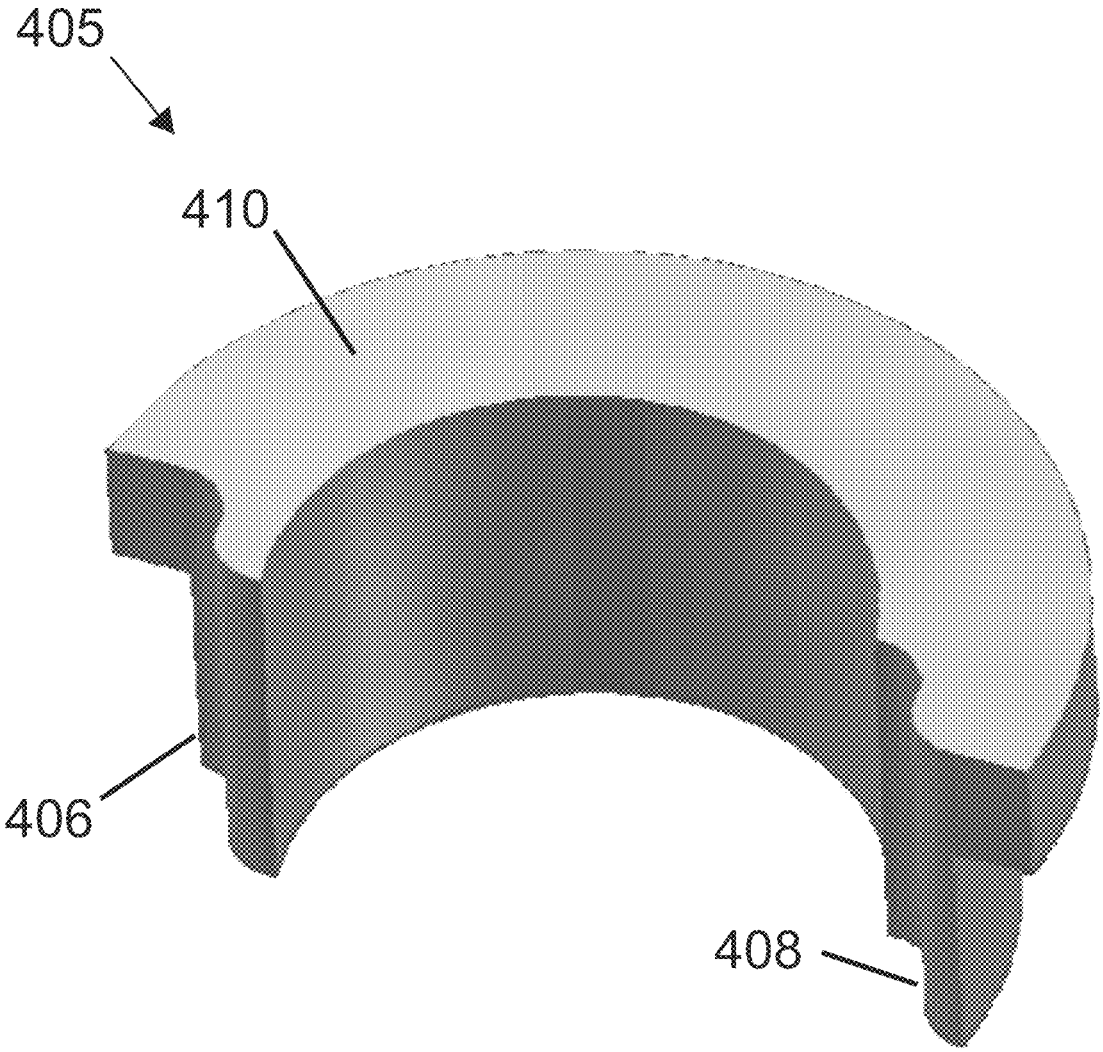
FIG. 9 is a perspective view of a split part for an electrode ring, used in some embodiments of the present disclosure.

The electrode rings 400 can be made as one integral piece. However, in some particular embodiments, the electrode ring is made from a pair of split parts. FIG. 9 is a perspective view of one such split part 405. As can be seen, two such split parts will together form a solid ring. The split part is in the form of cylindrical sidewall that has been cut in half by a plane oriented along the cylinder's axis of symmetry. The part has a curved face 406 at one end and a complementary curved face 408 on the other end (along the plane that cut the cylinder in half). This shape allows for replacement of the electrode ring without having to remove the copper lid and/or electrodes from the furnace. This design does not allow for a direct energy path through the seams of the electrode ring, either. A lip 410 is present as well on a top end. The electrode ring can be made from a refractory material selected from the group consisting of zirconia ($ZrO_2$), silicon carbide, alumina ($Al_2O_3$), silica ($SiO_2$), magnesia (MgO), tungsten carbide, boron nitride, hafnium carbide, tantalum hafnium carbide, chromia ($Cr_2O_3$), dolomite, and periclase. In particular embodiments, silicon carbide (SiC) is used.

Figure 10A:
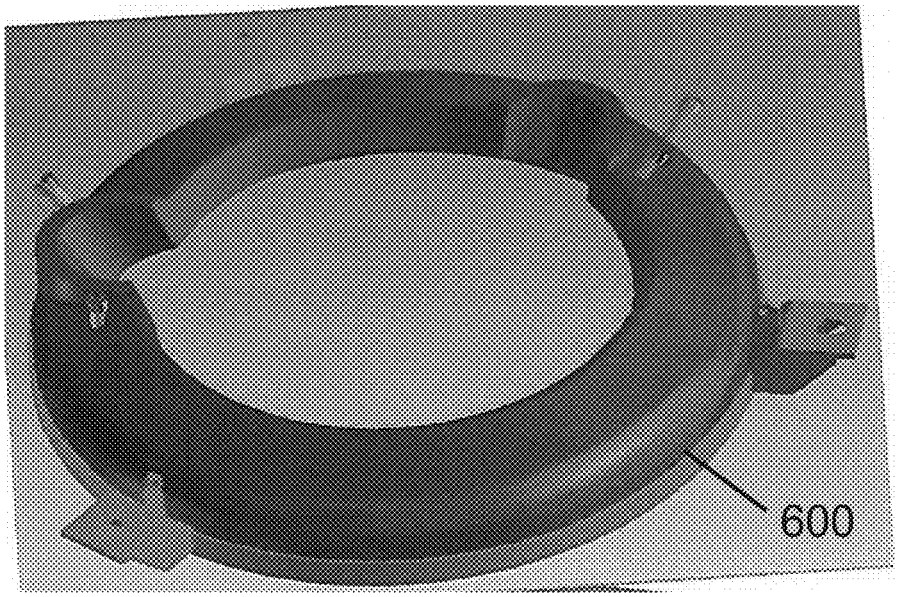
FIG. 10A and FIG. 10B are perspective views of a two-piece outer lid formed from a base ring section and an inner delta section, respectively, according to some embodiments of the present disclosure.
Figure 10B:
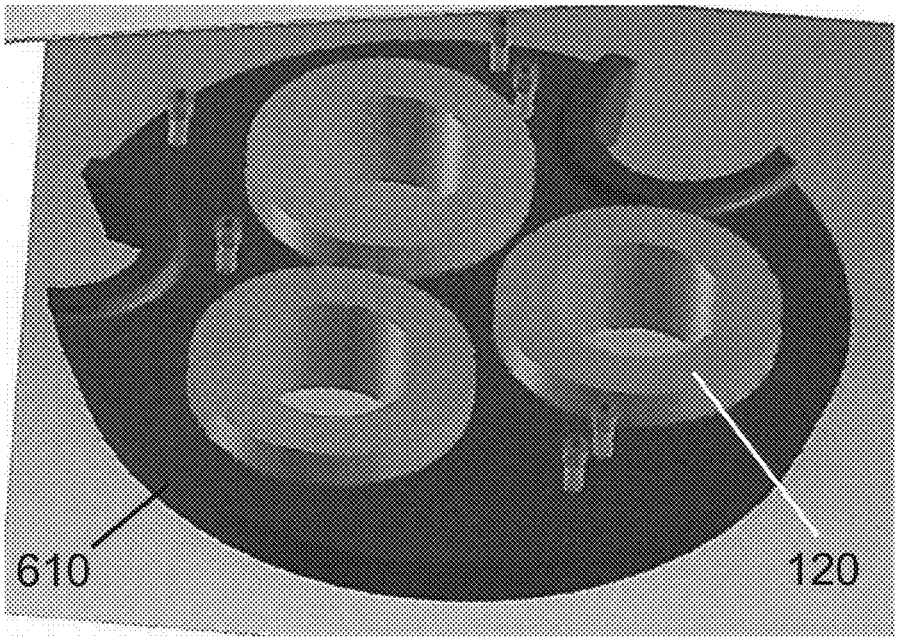

FIG. 10A and FIG. 10B illustrate one variation on the copper lid of the present disclosure. Whereas the copper lid of FIG. 1 is an integral one-piece lid, in some embodiments, the copper lid is made from the combination of two pieces. FIG. 10A shows the base ring section 600, and FIG. 10B shows the delta section 610. The base ring section contains two cooling circuits, and has an annular shape with a hollow spot in the center. The base ring section also contains the mounting supports. The delta section contains the electrode ports 120 and three cooling circuits. The two sections are fastened together. This construction may permit cost-effective replacement of either section at the appropriate time, without affecting the thermal performance of the copper lid.

Figure 12:
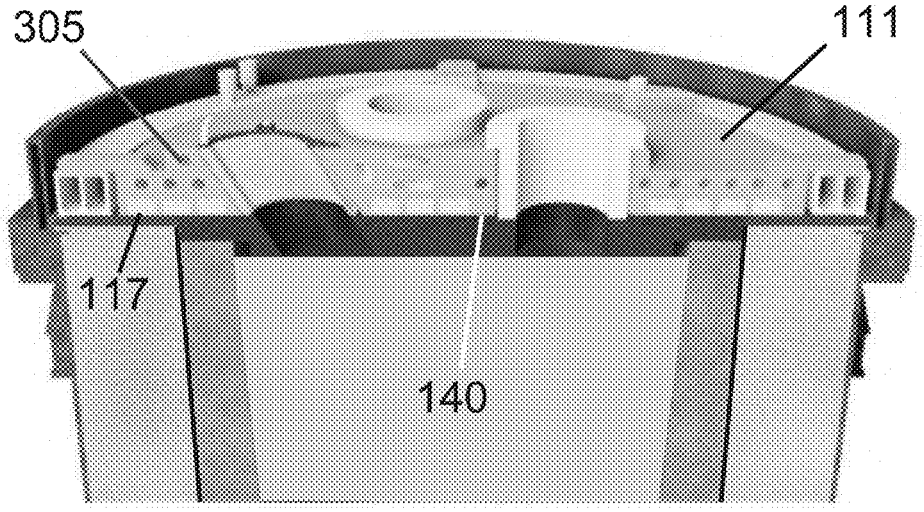
FIG. 12 is a cross-sectional view of an arc furnace using a second exemplary embodiment of a copper outer lid. Whereas the lid of FIG. 1 has a frustoconical disk shape on the bottom, this lid has a flat bottom surface with pockets therein.

FIG. 12 illustrates a second exemplary embodiment of the copper lid 111. This embodiment differs from that of FIG. 1 in that the bottom surface 140 is flat, as is the top surface. Pockets 117 are also present in the bottom surface. The cooling circuits are still as described in FIG. 3.

Figure 13:
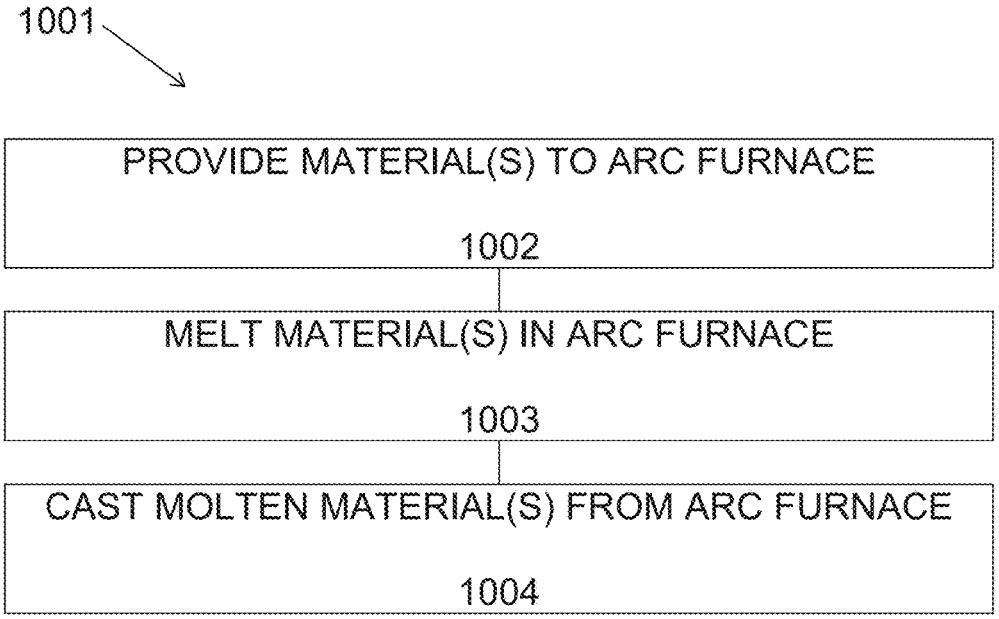
FIG. 13 is a flow chart illustrating an exemplary method for making a pure metal or metal alloy in accordance with some embodiments of the present disclosure.

FIG. 13 illustrates an exemplary method for producing pure metal or a metal alloy 1000. The method 1000 includes providing material(s) to an arc furnace 1002, melting the material(s) in the arc furnace 1003, and casting the molten material(s) from the arc furnace 1004.

It is particularly contemplated that the arc furnace using the copper outer lid is used to make a beryllium-containing alloy (e.g., a copper-beryllium alloy). In some embodiments, the copper-beryllium alloy further contains nickel and/or cobalt.

In particular embodiments, the alloy is a beryllium-copper master alloy containing from about 3.5 wt % to about 4.5 wt % of beryllium, and balance copper, which has a density of about 0.29 lbs/in$^3$ and a typical melting temperature of about 1600° F. Alternatively, the alloy is a beryllium-copper master alloy containing from about 9.5 wt % to about 10.5 wt % of beryllium, and balance copper, which has a density of about 0.29 lbs/in$^3$ and a typical melting temperature of about 1625° F.

The alloy may be C17000. C17000 has the following composition:

| Element | Wt % |
|---|---|
| Beryllium | 1.60-1.85 |
| Nickel + Cobalt | ≥0.20 |
| Nickel + Cobalt + Iron | ≤0.6 |
| Copper | Balance |

The alloy may be C17200. C17200 has the following composition:

| Element | Wt % |
|---|---|
| Beryllium | 1.80-2.00 |
| Nickel + Cobalt | ≥0.20 |
| Nickel + Cobalt + Iron | ≤0.6 |
| Copper | Balance |

The alloy may be C17410. C17410 has the following composition:

| Element | Wt % |
|---|---|
| Beryllium | 0.15-0.50 |
| Cobalt | 0.35-0.60 |
| Copper | Balance |

The alloy may be C17500. C17500 has the following composition:

| Element | Wt % |
|---|---|
| Beryllium | 0.20-0.60 |
| Cobalt | 2.4-2.7 |
| Copper | Balance |

The alloy may be C17510. C17510 has the following composition:

| Element | Wt % |
|---|---|
| Beryllium | 0.20-0.60 |
| Nickel | 1.4-2.2 |
| Copper | Balance |

The alloy may be Brush Alloy 310. Brush Alloy 310 has the following composition:

| Element | Wt % |
|---|---|
| Beryllium | 0.4-0.7 |
| Nickel | 0.8-1.3 |
| Cobalt | 0.8-1.3 |
| Copper | Balance |

The alloy may be Materion Alloy 390. Alloy 390 has the following composition:

| Element | Wt % |
|---|---|
| Beryllium | 0.15-0.5 |
| Nickel | 1.0-1.4 |
| Copper | Balance |

Not having to worry about lid deterioration allows increased flexibility for several operating parameters. For example, an organic binder can be used for pellet production. Use of an organic binder produces better pellets in a conventional furnace, but is detrimental to the carbon lid. The furnace could also be run at higher power, which would increase the reaction speed and produce more beryllium. In furnaces containing conventional carbon lids, higher power "eats" away at the lids.

The copper lid can be retrofit to an existing arc furnace or be a component of a new arc furnace. Optionally, fluid-cooled copper panels can also be used along the side of the furnace.

The present disclosure has been described with reference to exemplary embodiments. Obviously, modifications and alterations will occur to others upon reading and understanding the preceding detailed description. It is intended that the present disclosure be construed as including all such modifications and alterations insofar as they come within the scope of the appended claims or the equivalents thereof.

The invention claimed is:

1. An outer lid for an arc furnace, comprising:
a top surface and a bottom surface;
a plurality of electrode ports;
an off-gas chute;
a charge chute;
a plurality of cooling circuits within the outer lid for flowing a cooling fluid, each cooling circuit comprising an inlet and an outlet, wherein each electrode port has a cooling circuit surrounding it, and at least one cooling circuit runs around an outer perimeter of the outer lid; and
a fluid-cooled sleeve for the off-gas chute, wherein the fluid-cooled sleeve comprises a sidewall and a flange for securing the sleeve to the top surface of the outer lid, the sidewall having a cooling circuit running therethrough designed to deliver water first to a bottom of the sidewall and then flow around the sidewall to a top of the sidewall, and the sleeve having a length sufficient to extend entirely through the off-gas chute;
wherein the outer lid is made of copper or a copper alloy.

2. The outer lid of claim 1, wherein the bottom surface is shaped to promote accretion.

3. The outer lid of claim 1, wherein the plurality of electrode ports consists of three electrode ports located within a delta section of the outer lid.

4. The outer lid of claim 1, wherein the copper alloy is C81100.

5. The outer lid of claim 1, further comprising a fluid-cooled sleeve for the charge chute.

6. The outer lid of claim 1, further comprising a plurality of electrode rings, one electrode ring being used in each electrode port.

7. The outer lid of claim 6, wherein each electrode ring is made from a refractory material selected from the group consisting of zirconia ($ZrO_2$), silicon carbide, alumina ($Al_2O_3$), silica ($SiO_2$), magnesia (MgO), tungsten carbide, boron nitride, hafnium carbide, tantalum hafnium carbide, chromia ($Cr_2O_3$), dolomite, and periclase.

8. The outer lid of claim 1, wherein the bottom surface is flat.

9. An outer lid for an arc furnace, comprising:
a top surface and a bottom surface;
a plurality of electrode ports;
an off-gas chute;
a charge chute; and
a plurality of cooling circuits within the outer lid for flowing a cooling fluid, each cooling circuit comprising an inlet and an outlet, wherein each electrode port has a cooling circuit surrounding it, and at least one cooling circuit runs around an outer perimeter of the outer lid;
wherein the outer lid is made of copper or a copper alloy; and
wherein the outer lid is formed as a base ring section and a delta section, the delta section containing the plurality of electrode ports and the cooling circuits surrounding each electrode port, and the base ring section having an annular shape with a hollow spot in the center and containing the at least one cooling circuit running around the outer perimeter of the outer lid.

10. An arc furnace, comprising:
a crucible; and
a roof comprising an outer lid, wherein the outer lid comprises:
a top surface and a bottom surface;
a plurality of electrode ports;
an off-gas chute;
a charge chute;
a plurality of cooling circuits within the outer lid for flowing a cooling fluid, each cooling circuit comprising an inlet and an outlet, wherein each electrode port has a cooling circuit surrounding it, and at least one cooling circuit runs around an outer perimeter of the outer lid; and
a fluid-cooled sleeve for the off-gas chute, wherein the fluid-cooled sleeve comprises a sidewall and a flange for securing the sleeve to the top surface of the outer lid, the sidewall having a cooling circuit running therethrough designed to deliver water first to a bottom of the sidewall and then flow around the sidewall to a top of the sidewall, and the sleeve having a length sufficient to extend entirely through the off-gas chute;
wherein the outer lid is made of copper or a copper alloy.

11. The arc furnace of claim 10, wherein the roof further comprises an inner lid comprising carbon.

12. The arc furnace of claim 10, wherein the plurality of electrode ports consists of three electrode ports located within a delta section of the outer lid.

13. The arc furnace of claim 10, further comprising a plurality of electrode rings, one electrode ring being used in each electrode port.

14. An arc furnace, comprising:

a crucible; and a roof comprising an outer lid, wherein the outer lid comprises:

a top surface and a bottom surface;

a plurality of electrode ports;

an off-gas chute;

a charge chute; and a plurality of cooling circuits within the outer lid for flowing a cooling fluid, each cooling circuit comprising an inlet and an outlet, wherein each electrode port has a cooling circuit surrounding it, and at least one cooling circuit runs around an outer perimeter of the outer lid;

wherein the outer lid is made of copper or a copper alloy; and wherein the outer lid is formed as a base ring section and a delta section, the delta section containing the plurality of electrode ports and the cooling circuits surrounding each electrode port, and the base ring section having an annular shape with a hollow spot in the center and containing the at least one cooling circuit running around the outer perimeter of the outer lid.

15. The arc furnace of claim 10, wherein the copper alloy is C81100.

* * * * *